US006099060A

United States Patent [19]

Towers

[11] Patent Number: 6,099,060

[45] Date of Patent: Aug. 8, 2000

[54] BUNGEE CORD CARRIER

[76] Inventor: William J. Towers, 404 Storrs St., Dickson City, Pa. 18519

[21] Appl. No.: 09/157,202

[22] Filed: Sep. 18, 1998

[51] Int. Cl.[7] ..... A47F 7/00

[52] U.S. Cl. ..... 294/159; 294/169; 211/13.1

[58] Field of Search ..... 294/143, 159, 294/161, 169; 211/13.1, 195, 60.1, 61

[56] References Cited

U.S. PATENT DOCUMENTS

| | | | |
|---|---|---|---|
| 21,626 | 9/1858 | Porter | 211/195 |
| 255,215 | 3/1882 | Tuttle | 211/195 |
| 577,663 | 2/1897 | Peace | 211/195 |
| 579,056 | 3/1897 | Gibbons et al. . | |
| 1,297,959 | 3/1919 | Young . | |
| 1,540,244 | 6/1925 | Berglund . | |
| 2,038,781 | 4/1936 | Drew | 211/13.1 |
| 2,091,177 | 8/1937 | Drew | 211/13.1 |
| 2,930,486 | 3/1960 | Hoover | 211/60.1 |
| 4,123,012 | 10/1978 | Hough . | |
| 4,360,001 | 11/1982 | Thompson | 126/541 |
| 4,759,578 | 7/1988 | Gonzalez | 294/137 |
| 4,971,207 | 11/1990 | Baucom | 211/60.1 |
| 5,005,509 | 4/1991 | Williams | 114/90 |
| 5,139,208 | 8/1992 | Schooley . | |
| 5,176,419 | 1/1993 | Guerdet | 294/146 |
| 5,845,787 | 12/1998 | Dunnavant, Jr. | 211/13.1 |

*Primary Examiner*—Dean J. Kramer
*Assistant Examiner*—Paul T. Chin
*Attorney, Agent, or Firm*—Howson and Howson

[57] ABSTRACT

A frame-like carrier for a plurality of various sized, stretchable, elastic bungee cords. The carrier has at least three spaced apart cross arms for supporting bungee cords in an organized and compact manner between any two of the cross arms. The cross arms are appropriately spaced such that commercially available sizes of bungee cords are supported on the carrier in a slightly stretched condition. Thus, the cords are supported under enough tension on the carrier to resist disengagement and maintain proper positioning, yet a small enough amount of tension to prevent an accidently disengaged cord from creating a hazard as it snaps back into a non-tensioned condition.

18 Claims, 4 Drawing Sheets

12
26
10
30
32
24
40
34
38
14
36
22
28
16
18
20
42

FIG. 6
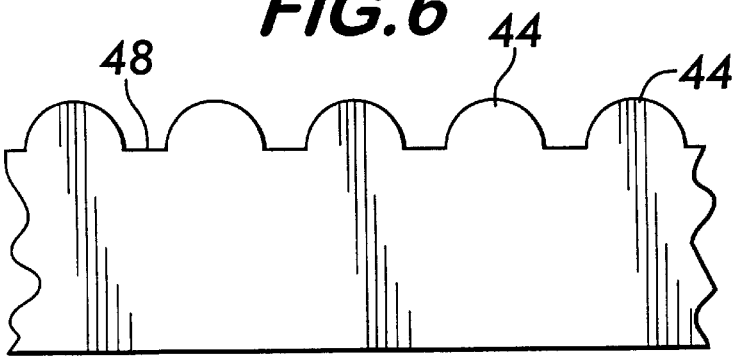
FIG. 7
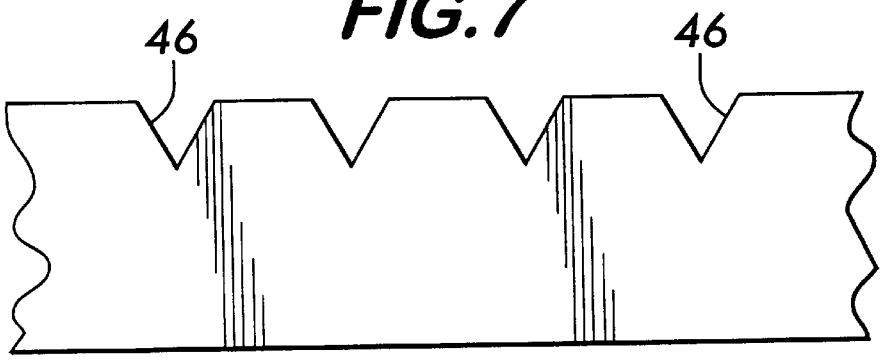
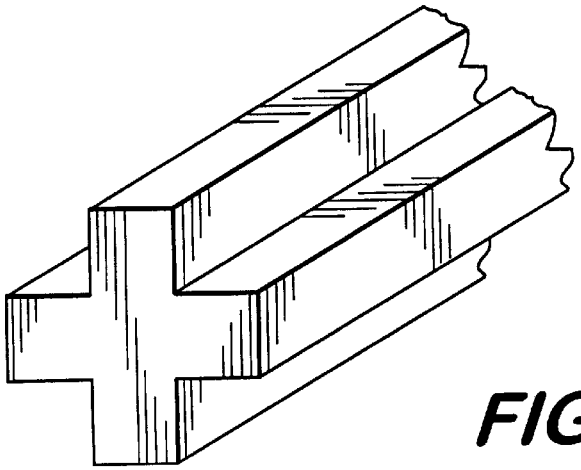
FIG. 8

BUNGEE CORD CARRIER

FIELD OF THE INVENTION

The present invention relates to carriers, or holders, for cords and the like, and more particularly, the present invention relates to a thin, frame-like carrier for holding, organizing, storing, and/or packaging a plurality of elongate, stretchable, elastic bungee cords of varying lengths.

BACKGROUND OF THE INVENTION

Bungee cords provide a convenient tool for tying down, or maintaining the positioning of, an article in a given location. For instance, articles being transported in a truck bed are subject to a variety of forces, such as wind and road conditions, which necessitate that the articles be tightly secured to the truck to prevent unwanted movement, damage, or loss of the articles. Bungee cords are made of various stretchable materials or rubber and have opposite ends with hook-shaped fasteners so that they can be readily hooked or unhooked around articles of any shape. The stretchable, elastic cords are commercially available in many sizes, such as 12, 18, 24, 30, 36 and 42 inches measured in an unstretched, or non-tensioned, condition.

Since bungee cords, or like stretchable, elastic cords, provide such a convenient, adaptable, inexpensive and simple-to-use tool, it is common for a user of bungee cords to possess a large number of cords in many different sizes, or lengths. Typically, the cords are located in a pile or stored and carried in a five gallon bucket, or the like. Thus, the bungee cords are stored in a tangled, unorganized manner which makes it difficult to quickly locate and untangle a particular size of bungee cord sought. In addition, generally the cords are packaged and sold in relatively bulky plastic bags. This type of packaging makes it difficult for a consumer to visually inspect the number, type and condition of the cords, and provides a bulky package which is difficult to display in an aesthetic and efficient manner.

The use of frame-like holders for other types of cords, such as, electrical extension cords, strings of lights, fishing lines, clotheslines, kite strings, chalk lines, yarn and fence wire are known. For example, U.S. Pat. No. 5,139,208 issued to Schooley discloses a relatively flat rack having a pair of spaced-apart cross arms around which a single, relatively long, non-stretchable cord having a complex structure, such as Christmas tree lights, can be wound and stored. Other Examples include: U.S. Pat. No. 4,123,012 issued to Hough which discloses a holder for an electric extension cord; U.S. Pat. No. 1,540,244 issued to Bergland which discloses a reel for clothesline; U.S. Pat. No. 1,297,959 issued to Young which discloses a reel for chalk line; and U.S. Pat. No. 579,056 issued to Gibbons et al. which discloses a reel for fence wire.

While many of the known holders, or reels, are suited for use with relatively long, non-stretchable cords which are readily capable of being repeatedly wound around opposite ends of a frame-like structure, they may not be useful for efficiently holding relatively short, stretchable, elastic cords having hook-shaped fasteners at opposite ends thereof. For purposes of this application, the term bungee cord includes any elongate cord which is longitudinally stretchable and elastic and has any type of fasteners at opposite ends thereof.

Although various ones of the aforementioned holders or reels may be satisfactory for their intended purposes, there is a need for a carrier particularly designed to provide a means of holding, organizing, storing and/or packaging bungee cords in an efficient manner. The carrier should be capable of holding a plurality of bungee cords of a variety of lengths, or sizes, in an untangled manner which permits ready visual location of a particular size of bungee cord. In addition, since the elastic nature of bungee cords can create a potential hazard when a bungee cord under tension accidently becomes unhooked, the carrier should provide a safe means of holding bungee cords in a manner which prevents injury or damage from accidently unhooked cords. Finally, the carrier should be inexpensive to manufacture and have a slim profile which enables the cords to be efficiently stored in a minimum of space.

OBJECTS OF THE INVENTION

With the foregoing in mind, a primary object of the present invention is to provide a bungee cord carrier capable of holding a plurality of bungee cords in a wide range of lengths, or sizes.

Another object of the present invention is to provide a bungee cord carrier which efficiently holds bungee cords in an organized manner which permits ready visual location of a particular size of bungee cord among a variety of different sized bungee cords.

A further object of the present invention is to provide a bungee cord holder for supporting a plurality of cords in a safe manner which resists unwanted disengagement of the bungee cords from the carrier and which prevents creating a potential hazard associated with an accidently disengaged tensioned cord.

A still further object of the present invention is to provide a bungee cord carrier which is inexpensive to manufacture, which can be used as packaging for the sale of bungee cords, and which can be stored in a minimum of space.

SUMMARY OF THE INVENTION

More specifically, the present invention provides a carrier for elongate bungee cords having opposite ends with hook-shaped fasteners. The carrier has at least three elongate cross arms for supporting bungee cords extending in a transverse direction between any two of the cross arms. Each of the cross arms are capable of engaging the hook-shaped fasteners of the bungee cords such that when the end of one bungee cord engages one of the cross arms and the opposite end of the same bungee cord engages another of the cross arms, the bungee cord is supported under tension in a slightly stretched condition on the carrier.

The cross arms are spaced-apart at distances which permit bungee cords of different lengths to be supported in a slightly stretched condition on the carrier. The slightly stretched condition provides a sufficient amount of tension to maintain positioning of the bungee cords on the carrier and to resist unwanted disengagement of the bungee cords from the carrier, yet provides a small enough amount of tension so that an accidently disengaged bungee cord does not create a hazard. Thus, the carrier is capable of holding a plurality of bungee cords having various lengths in a compact, organized and safe manner.

BRIEF DESCRIPTION OF THE DRAWINGS

The foregoing and other objects, features and advantages of the present invention should become apparent from the following description when taken in conjunction with the accompanying drawings, in which:

FIG. 6 is a front elevational view of an alternate embodiment of a portion of one cross arm of the bungee cord carrier according to the present invention;

FIG. 7 is a front elevational view of another alternate embodiment of a portion of one cross arm of the bungee cord carrier according to the present invention; and FIG. 8 is a cross sectional view of still another alternate embodiment of a portion of one cross arm of the bungee cord carrier according to the present invention.

DETAILED DESCRIPTION OF THE PREFERRED EMBODIMENT

Figure 1:
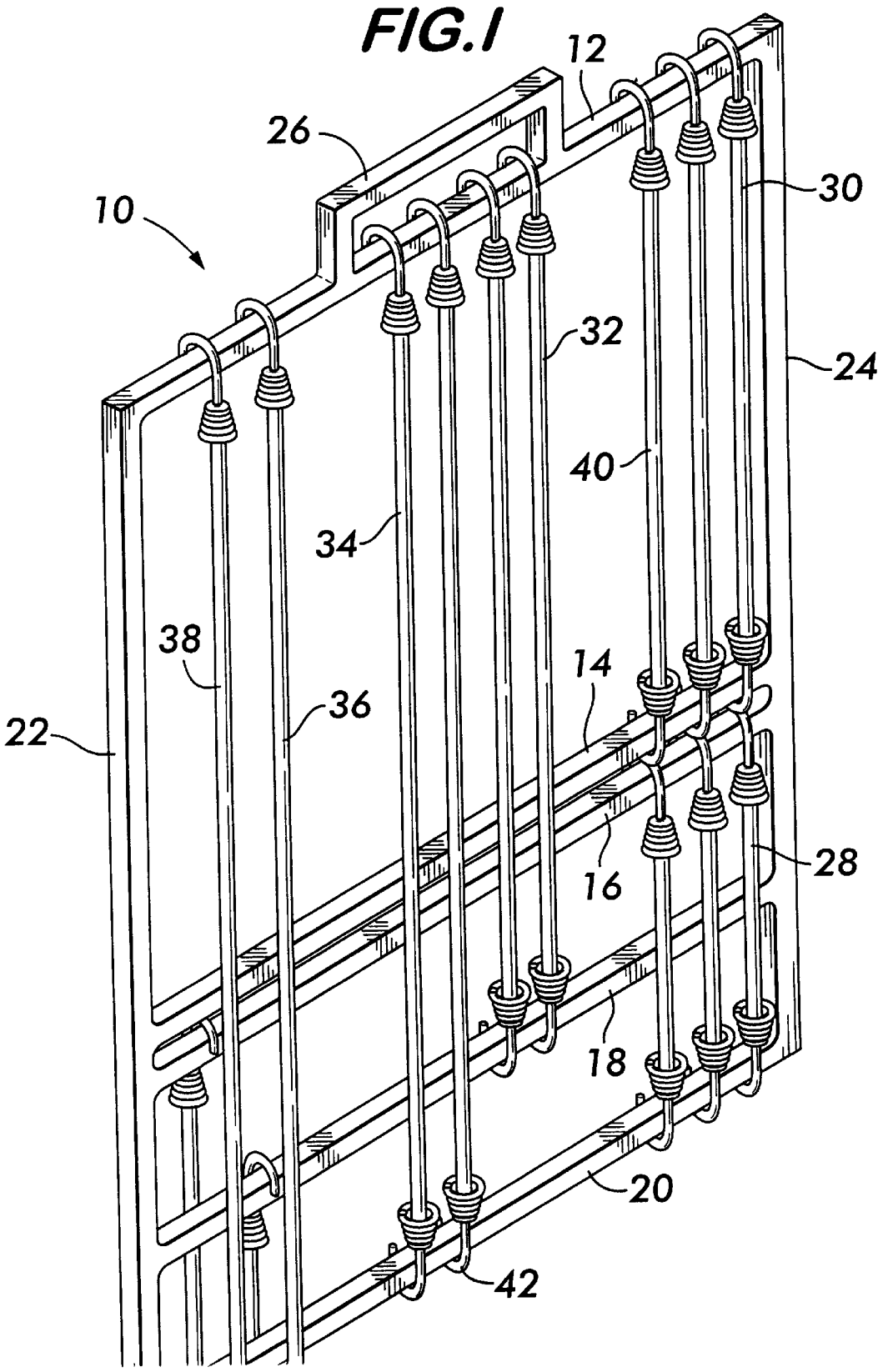
FIG. 1 is a perspective view of a bungee cord carrier embodying the present invention.

As illustrated in FIG. 1, the carrier 10 of the present invention provides a means for holding bungee cords in a compact and organized manner. Such a carrier 10 has many advantages over the conventional means of storing bungee cords in a pile on the floor or in a bucket. The carrier 10 of the present invention holds bungee cords in an untangled manner and permits ready and quick visual inspection of the number, type and size of bungee cords on the carrier. Thus, the carrier 10 enables a particular size of bungee cord to be readily located among a stored variety of different-sized bungee cords. When used for packaging purposes, the carrier 10 and the bungee cords thereon can be efficiently displayed in an aesthetic manner and can be shrink-wrapped in a clear plastic film so that the entire length of each bungee cord can be visually inspected by consumers.

The carrier 10 is preferably provided by a relatively flat frame-like structure having three or more spaced-apart cross arms for supporting bungee cords therebetween. The illustrated embodiment includes five cross arms, 12, 14, 16, 18 and 20 which extend in a parallel relation in a common plane. The opposite ends of each cross arm are connected to and between a pair of elongate framing members, 22 and 24, which extend transversely, preferably perpendicularly, to the cross arms and structurally support the cross arms in a space-apart configuration. A handle 26 extends upwardly from the cross arm 12 so that the frame-like carrier can be readily grasped and carried.

By way of example, and not be way of limitation, the carrier 10 is illustrated holding a set of bungee cords including six different-sized bungee cords, 28, 30, 32, 34, 36 and 38. Each bungee cord includes a stretchable elastic cord portion 40 which has opposite ends each with a hook-shaped fastener 42. The only difference between bungee cords 28–38 is the length of the cord portion 40 in a non-tensioned, or non-stretched, condition. For instance, in order from smallest to longest, bungee cord 28 is the shortest followed by 30, 32, 34, 36 and 38, which is the longest illustrated bungee cord.

The cross arms, 12–20, are capable of engaging the hook-shaped fastener 42 of the bungee cords. Thus, when one of the fasteners 42 of one bungee cord is engaged with one of the cross arms and the opposite fastener 42 of the same bungee cord is engaged with another of the cross arms, the bungee cord is supported on the carrier 10. For example, bungee cord 28 is engaged to and extends between cross arms 16 and 20; bungee cord 30 is engaged to and extends between cross arms 12 and 14; bungee cord 32 is engaged to and extends between cross arms 12 and 18; and bungee cord 34 is engaged to and extends between cross arms 12 and 20.

To accommodate larger sizes of bungee cords, the cords can have one end hooked to the uppermost cross arm, can extend to and around the lowermost cross arm, and can be engaged to a cross arm intermediate of the uppermost and lowermost cross arms. For example, the bungee cord 36 has one end engaged to the cross arm 12, extends to and around the cross arm 20, and has an opposite end engaged to cross arm 18; and the bungee cord 38 has one end engaged to the cross arm 12, extends to and around the cross arm 20, and has an opposite end engaged to cross arm 16.

Figure 2:
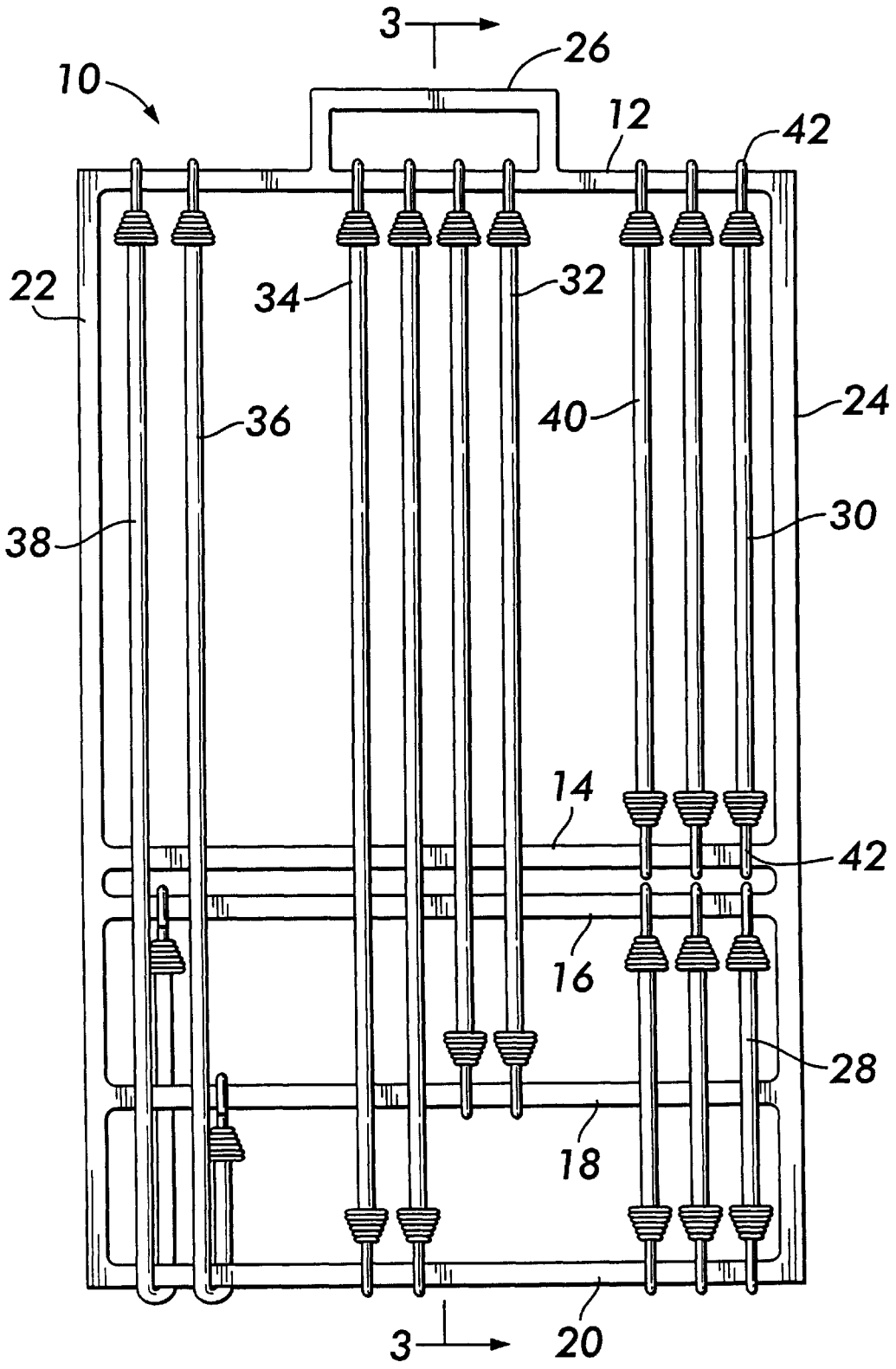
FIG. 2 is a front elevational view of the bungee cord carrier illustrated in FIG. 1.

As best illustrated in FIG. 2, the various sized bungee cords are supported by the carrier 10 in a neat, organized manner. To this end, the bungee cords 28, 30, 32, 34, 36 and 38 are positioned on the carrier 10 such that they extend transversely, preferably perpendicularly, to the cross arms 12–20 and substantially parallel to the other bungee cords. Further, the bungee cords 28 and 30 are positioned in an end-to-end relationship, while bungee cords 32, 34, 36, 38 are positioned in a side-by-side relationship with each other and with bungee cords 28 and 30.

One of the important concepts of the present invention is that each of the cross arms 12–20 are spaced-apart at pre-determined distances so that each bungee cord 28–38 is supported by the carrier 10 in a stretched condition. The purpose of the stretched condition of the bungee cord is to ensure that the bungee cord maintains its intended positioning on the carrier 10 and to resist unwanted disengagement of the bungee cords from the carrier 10. For example, when a bungee cord, which has a length of 18 inches in an unstretched/non-tensioned condition, is engaged on the carrier 10, the bungee cord will be stretched to a length greater than 18 inches so that the bungee cord is supported on the carrier 10 under a pre-determined amount of tension.

The carrier 10 supports the bungee cords under tension, yet in a safe manner. To this end, the bungee cords are only slightly stretched beyond their normal, non-stretched length when they are supported on the carrier 10. A bungee cord which is under a significant amount of tension and which becomes accidently disengaged, creates a potential hazard as it snaps back into a non-tensioned condition. Therefore, the spacing of the cross arms 12–20 of carrier 10 are designed to provide only a limited amount of tension in each bungee cord so that an accidently disengaged bungee cord does not snap back with enough force to cause damage or injury.

The above discussed goals of providing enough tension to maintain bungee cord positioning and to resist disengagement, and of providing only a limited amount of tension to prevent creation of a potential hazard, are realized by designing the spacing between the cross arms 12–20 in such a manner that each bungee cord on the carrier is stretched in a range of about 0.01 to about 10.0 inches beyond its normal unstretched condition. Preferably, the range is about 0.05 inches to about 3.0 inches of stretch beyond the normal unstretched length of the bungee cord. For example, a bungee cord having a non-tensioned length of 18 inches, may be stretched one inch when it is engaged on the carrier 10 so that it has a length of 19 inches in the slightly stretched condition on the carrier 10.

In alternate embodiments of the cross arms of the present invention, as illustrated in FIGS. 6 and 7, alignment elements 44 and 46 can be utilized to further ensure that the bungee cords maintain proper positioning on the carrier. For instance, any or all of the cross arms can have laterally spaced beads 44 or notches 46 in order to provide a discrete number of locations for the hook-shaped fasteners 42 of the bungee cords. In FIG. 6, the space 48 between any pair of adjacent beads 44 define the potential location of one hook-shaped fastener 42; and in FIG. 7, each notch 46 defines a potential location of one hook-shaped fastener 42. The alignment elements ensure proper spacing between bungee cords and prevent bunching of the bungee cords which may occur as a result of rough handling, transportation, or the like.

Figure 3:
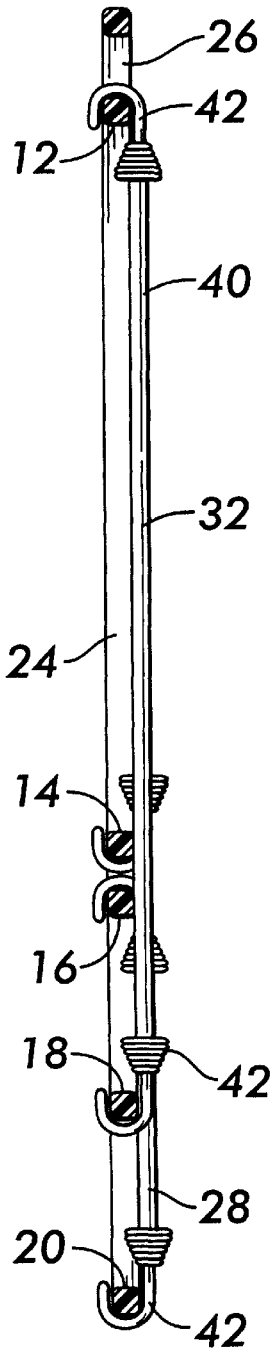
FIG. 3 is a cross-sectional view of the bungee cord carrier illustrated in FIG. 2, the view taken along the line 3—3.

Various cross-sectional shapes for the cross arms can be utilized to enhance the engagement between the hook-shaped fasteners 42 and the cross arms of the carrier and to provide the cross arms of the carrier with a deformation resistant structure. For instance, the cross sectional shape of the cross arms 12–20 as illustrated in FIG. 3 is rectangular, while a cross-shaped cross section is utilized on the cross arm illustrated in FIG. 8. Other cross sectional shapes can also be utilized.

Figure 5:
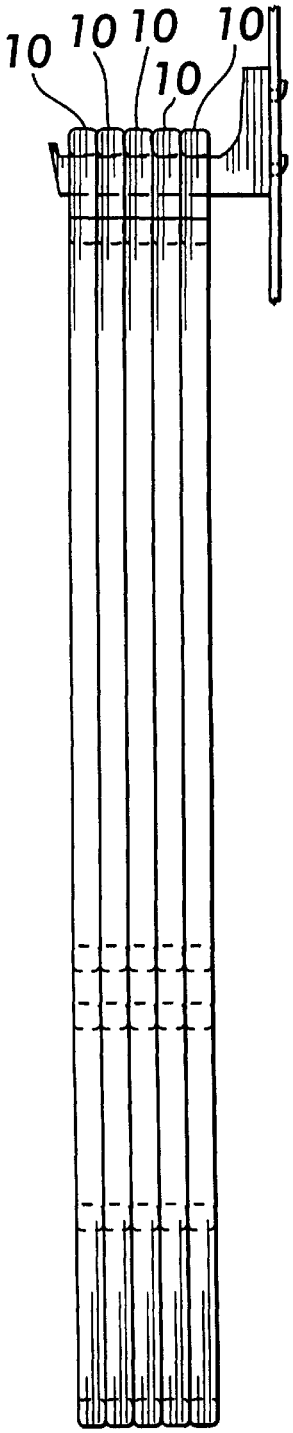
FIG. 5 is a side elevational view of a plurality of the bungee cord carriers illustrated in FIG. 1 hooked on a display rack.

As illustrated in FIG. 5, the slim profile of the carrier 10 enables it to be hung and displayed with several identical carriers in an efficient, compact and aesthetically pleasing manner. Although not illustrated, each of the carriers 10 in FIG. 5 could support a plurality of different sized bungee cords and be shrink-wrapped so that the carrier 10 forms the packaging for the bungee cords. As illustrated in FIG. 3, such a package would also have a slim profile and be capable of being hung and displayed with several identical packages in an efficient, compact and aesthetically pleasing manner which enables consumers to visually inspect the bungee cords from end to end.

Figure 4:
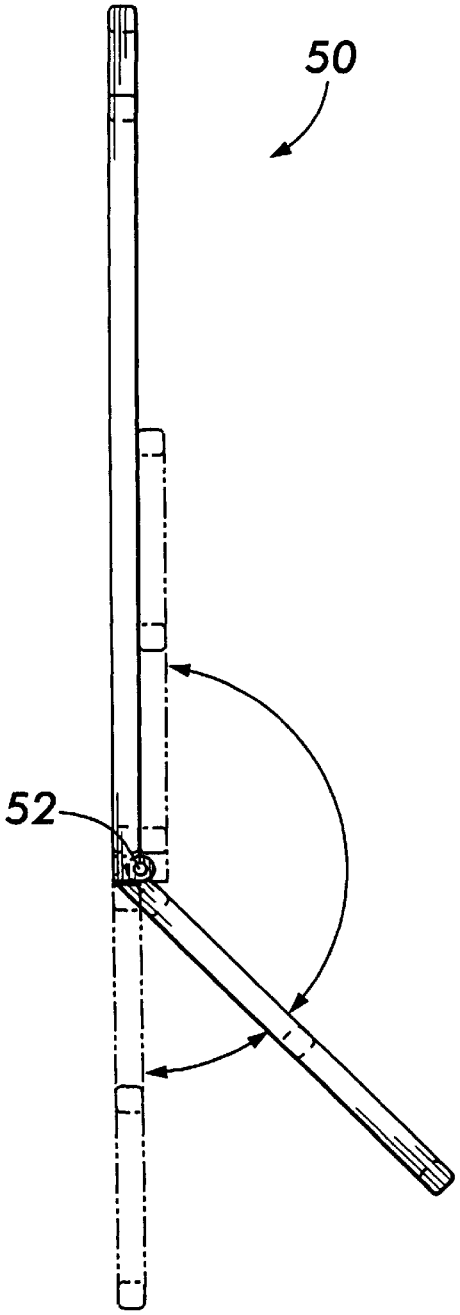
FIG. 4 is a side elevational view of an alternate embodiment of a foldable bungee cord carrier according to the present invention.

Another embodiment of the present invention is illustrated in FIG. 4. A carrier 50, similar in construction to previously discussed carrier 10, is provided with a hinge 52 in both of its elongate framing members so that the carrier 50 can be folded into an even more compact structure. For example, when all bungee cords have been removed from the carrier 50, it can be manipulated into a folded condition and stored until later needed. Alternatively, the carrier 50 can be designed to fold with bungee cords located thereon in order to fit the carrier 50 and bungee cords into an even smaller storage space.

Preferably, the aforementioned carriers of the present invention are made of plastic by injection molding or extrusion techniques. For instance, the frame-like structure of carrier 10 can be injection molded as one piece with the cross arms 12–20, framing members, 22 and 24, and handle 26 being integrally formed. Alternatively, the carrier can be made of any metal, wood or other materials.

By way of example, and not by way of limitation, the frame-like structure of carrier 10 can have the following dimensions. The spacing between cross arm 12 and cross arm 14 is about 18.5 inches and is particularly suited for supporting bungee cords having about an 18 inch length in a non-tensioned condition; the spacing between cross arm 12 and cross arm 18 is about 25.25 inches and is particularly suited for supporting bungee cords having about a 24 inch length in a non-tensioned condition; the spacing between cross arm 12 and cross arm 20 is about 31.5 inches and is particularly suited for supporting bungee cords having about a 30 inch length in a non-tensioned condition; and the spacing between cross arm 16 and cross arm 20 is about 12.5 inches and is particularly suited for supporting bungee cords having about a 12 inch length in a non-tensioned condition. Each cross arm, 12–20, has a length of about 17 inches. The cross arms 12–20 and framing members 22 and 24 have a ⅜ inch by ⅜ inch square shape in transverse cross-section, thus providing the carrier 10 with a slim profile about ⅜ inches in width.

Many alternative configurations can be utilized for a carrier made in accordance with the present invention. While a carrier 10 with five cross arms 12–20 is illustrated, the carrier can have as few as three load bearing, bungee cord supporting cross arms. The carrier could also be made with four cross arms or more. The spacing between the cross arms and the length of the cross arms can vary depending on the size and number of bungee cords intended to be carried. The cross arms could extend in a non-parallel relation such that longer bungee cords are carried at diverging ends of any two cross arms and shorter bungee cords are carried at converging ends of the cross arms. In addition, the carrier does not have to be flat and can be formed in a three dimensional shape. In this case, the cross arms would not extend on the same plane and could form a pyramid-shaped framework or a multi-sided shaped framework.

Thus, the above-described bungee cord carrier according to the present invention provides a compact, organized and safe storage and merchandising device for a plurality of bungee cords of varying lengths.

While a preferred bungee cord carrier has been described in detail, various modifications, alterations, and changes may be made without departing from the spirit and scope of the bungee cord carrier according to the present invention as defined in the appended claims.

What is claimed is:

1. A carrier for elongate stretchable cords each having at least one end with a fastener, comprising:

at least three elongate cross arms for supporting stretchable cords extending in a transverse direction between any two of said cross arms, each of said cross arms being capable of engaging the fasteners of the cords such that when the end of one cord engages one of said cross arms and the opposite end of the same cord engages another of said cross arms, the cord is supported under tension in a slightly stretched condition on the carrier;

said at least three cross arms being spaced-apart at distances which permit cords of different lengths to be supported in said slightly stretched condition on the carrier, said slightly stretched condition providing a sufficient amount of tension to maintain positioning of the cords on the carrier and to resist unwanted disengagement of the cords from the carrier, yet providing a small enough amount of tension so that an accidently disengaged cord does not create a hazard;

said at least three spaced-apart cross arms being parallel and extending in a common plane so that the cords of different lengths can be supported on the carrier both in a substantially parallel, side-by-side positioning and in a substantially parallel, end-to-end positioning; and each of said cross arms being cross-shaped in transverse cross section;

whereby the carrier is capable of holding a plurality of stretchable cords having various lengths in a compact, organized and safe manner.

2. A carrier according to claim 1, wherein said at least three cross arms include at least four cross arms.

3. A carrier according to claim 2, wherein said at least three cross arms include at least five cross arms capable of supporting at least six different length sizes of stretchable cords.

4. A carrier according to claim 1, wherein at least three of said cross arms have a plurality of alignment elements for positioning the fasteners on said cross arm and for preventing the fasteners from lateral movement on said cross arm.

5. A carrier according to claim 4, wherein said plurality of alignment elements are formed by a plurality of notches laterally spaced on each of said cross arms.

6. A carrier according to claim 4, wherein said plurality of alignment elements are formed by a plurality of upstanding beads laterally spaced on each of said cross arms.

7. A carrier according to claim 1, further comprising at least one elongate member extending transversely relative to said cross arms and connecting to said cross arms for structurally supporting said cross arms and maintaining said cross arms at said spaced-apart distances.

8. A carrier according to claim 7, wherein said elongate member has a hinge so that the carrier can be folded into a compact condition.

9. A carrier according to claim 1, wherein said spaced apart distances of said cross arms provide said slightly stretched condition such that each cord supported on the carrier is about 0.01 inches to about 10.0 inches longer in length than the cord's length in a non-tensioned condition.

10. A carrier according to claim 9, wherein said spaced apart distances of said cross arms provide said slightly stretched condition such that each cord supported on the carrier is about 0.05 inches to about 3.0 inches longer in length than the cord's length in a non-tensioned condition.

11. A combination cord set and carrier, comprising:

a set of elongate, stretchable, elastic cords each having at least one end with a fastener and a pre-determined length in a non-tensioned condition, said set including cords of at least two different pre-determined lengths; and a carrier having at least three cross arms for supporting said cords stretched in a transverse direction between any two of said cross arms and a framing member extending transversely relative to said cross arms and connecting to said cross arms for structurally supporting said cross arms and maintaining said cross arms at predetermined spaced-apart distances;

said spaced-apart cross arms extending in a common plane;

whereby the carrier is capable of holding the cord set in a compact and organized manner.

12. A combination cord set and carrier according to claim 11, wherein said spaced-apart cross arms are parallel.

13. A combination cord set and carrier according to claim 12, wherein said carrier has a pair of elongate framing members utilized to structurally support said cross arms, wherein said cross arms have opposite ends; and wherein said pair of elongate framing members interconnect to said cross arms at said opposite ends of said cross arms.

14. A combination cord set and carrier according to claim 11, wherein said set includes cords of at least three different pre-determined lengths.

15. A combination cord set and carrier, comprising:

a plurality of elongate, stretchable, elastic cords having different lengths when in a non-tensioned condition and each having at least one end with a fastener;

a first, second and third elongate cross arm for supporting said cords stretched in a transverse direction between any two of said cross arms, each of said cross arms being capable of engaging the fasteners of the cords such that when the end of one cord engages one of said cross arms and the opposite end of the same cord engages another of said cross arms, the cord is supported in a slightly stretched condition on the carrier; and an elongate framing member extending transversely relative to said cross arms and connecting to said cross arms for structurally supporting said cross arms and maintaining said cross arms at predetermined spaced-apart distances;

said cross arms being spaced-apart at distances which permit said cords to be supported in said slightly stretched condition on the carrier, said slightly stretched condition providing a sufficient amount of tension to maintain positioning of the cords on the carrier and to resist unwanted disengagement of the cords from the carrier, yet providing a small enough amount of tension so that an accidently disengaged cord does not create a hazard;

said spaced-apart cross arms extending in a common plane;

whereby the carrier is capable of holding the cord set in a compact, organized and safe manner.

16. A combination cord set and carrier according to claim 15, wherein said cross arms are parallel.

17. A combination cord set and carrier according to claim 16, wherein said second cross arm is located between said first and third cross arms, and wherein said predetermined spaced distance between said first and second cross arms is greater than said predetermined spaced distance between said second and third cross arms.

18. A combination cord set and carrier according to claim 16, wherein said set includes cords of at least four different lengths.

* * * * *